US006997857B2

(12) United States Patent
Bowman et al.

(10) Patent No.: US 6,997,857 B2
(45) Date of Patent: Feb. 14, 2006

(54) POSTURE CORRECTION EXERCISE DEVICE

(75) Inventors: Jason Bowman, Roselle, IL (US); Robert Gearhart, Carpentersville, IL (US)

(73) Assignee: Beyond the Curve, L.L.C., Carpentersville, IL (US)

( * ) Notice: Subject to any disclaimer, the term of this patent is extended or adjusted under 35 U.S.C. 154(b) by 56 days.

(21) Appl. No.: 10/393,332

(22) Filed: Mar. 20, 2003

(65) Prior Publication Data

US 2004/0185991 A1 Sep. 23, 2004

(51) Int. Cl.
*A63B 26/00* (2006.01)

(52) U.S. Cl. ..... 482/148; 482/121; 482/126; 482/129; 482/142

(58) Field of Classification Search ..... 482/121–133, 482/140, 142, 148, 907, 62
See application file for complete search history.

(56) References Cited

U.S. PATENT DOCUMENTS

| | | | | |
|---|---|---|---|---|
| 4,500,089 A | | 2/1985 | Jones | |
| 5,100,131 A | | 3/1992 | Fong | |
| 5,256,126 A | | 10/1993 | Grotstein | |
| 5,288,130 A | | 2/1994 | Foster | |
| 5,496,247 A | * | 3/1996 | Anderson | 482/142 |
| 5,599,261 A | * | 2/1997 | Easley et al. | 482/130 |
| 5,833,590 A | | 11/1998 | Chiu et al. | |
| 6,059,701 A | | 5/2000 | George et al. | |
| 6,113,522 A | * | 9/2000 | Fontenot et al. | 482/111 |
| 6,213,923 B1 | | 4/2001 | Cameron et al. | |
| 6,248,047 B1 | * | 6/2001 | Abdo | 482/130 |
| 6,312,366 B1 | * | 11/2001 | Prusick | 482/130 |
| 6,368,260 B1 | * | 4/2002 | Crews | 482/142 |
| 6,398,699 B1 | * | 6/2002 | Yang | 482/142 |
| 6,458,062 B2 | * | 10/2002 | Conner | 482/129 |
| 6,494,819 B1 | * | 12/2002 | Boland | 482/130 |
| 6,500,104 B1 | * | 12/2002 | Rich | 482/123 |
| 6,726,608 B1 | * | 4/2004 | Hsu | 482/130 |
| 2003/0087737 A1 | * | 5/2003 | Studdard | 482/142 |
| 2004/0009860 A1 | * | 1/2004 | Lin | 482/148 |

* cited by examiner

*Primary Examiner*—Gregory L. Huson
*Assistant Examiner*—Lori Amerson
(74) *Attorney, Agent, or Firm*—Leon I. Edelson; William C. Clarke; Levenfeld Pearlstein

(57) ABSTRACT

A posture correction exercise device is disclosed to aid in correcting the common postural condition of kyphosis lordosis by aiding in the exercise of the spinal erectors to strengthen the erectors to pull the user's spine and torso backward into normal alignment and by exercise of the mid-trapezious, rhomboid and posterior deltoid muscles to strengthen these muscles to pull the user's shoulder blades together and force the shoulders into normal alignment. The device operates by seating the user upon a declined seat to provide increased resistance by gravity to provide increased resistance to backward movement of user's body and rotation of user's arms against tension mounted on tension back and resistance of said tension against backward movement by the user's body wherein hands of the user are positioned in supinated palms-up hand positions by grasping ball grips affixed under the rearward rotational arm positioners of the device at the exterior ends of the arm positioners.

26 Claims, 5 Drawing Sheets

POSTURE CORRECTION EXERCISE DEVICE

CROSS REFERENCE TO RELATED APPLICATIONS

Not applicable.

BACKGROUND OF THE INVENTION

Many available home or gym exercise devices/programs focus on improving one's health by way of building muscle and/or burning fat. Improvement in the shape and composition of one's body leads to better overall health. Beyond building muscle and burning fat, the maintenance of good posture is an essential aspect of overall health overlooked by mainstream fitness. The posture exercise device satisfies a need for an affordable, easy-to-use, at-home treatment for poor posture or maintenance of good posture.

Posture is essentially the position of the body in space. Optimal posture is the state of muscular and skeletal balance that protects the supporting structures of the body against injury or progressive deformity, whether at work or rest. Correct posture involves the positioning of the joints to provide minimum stress on the joints of the body. Posture also involves the chain-link concept of body mechanics in which problems anywhere along the body chain can lead to problems above or below that point. For example, knee pain can arise from pelvic joint disorders. Proper posture:

- Keeps bones and joints in the correct alignment so that muscles are being used properly.
- Helps decrease the abnormal wearing of joint surfaces that could result in arthritis.
- Decreases the stress on the ligaments holding the joints of the spine together.
- Prevents the spine from becoming fixed in abnormal positions.
- Prevents fatigue because muscles are being used more efficiently, allowing the body to use less energy.
- Prevents strain or overuse problems.
- Prevents backache and muscular pain.
- Contributes to good appearance.

The causes of the abnormal postural alignments shown are of two categories: positional and structural. Structural causes are basically permanent anatomical deformities not amenable to correction by conservative treatments. Positional causes of poor posture include

- Poor postural habit—occurs when an individual does not maintain a correct posture, due to various reasons: pregnancy, high-heeled shoes, poor work environment, poor sitting and standing habits
- Psychological factors, especially self-esteem
- Normal developmental and degenerative processes
- Pain leading to muscle guarding and avoidance postures
- Muscle imbalance, spasm, or contracture
- Respiratory conditions
- General weakness
- Excess weight
- Loss of proprioception—the ability to perceive the position of the body The symptoms of kyphosis-lordosis thus arise for many reasons. The most common of which are poor postural habits, lack of body awareness, inherent anatomical imbalances, overweight and ineffective or non-existent exercise. A typical scenario involves a person who spends much of their waking hours in a seated (slouched) position either at work, home or office. While seated or standing, tasks are performed in front of the face (through no fault of their own). Front working muscles may become stronger and tighter if not stretched, while non-working muscles will lengthen. Body awareness is lost through habitual front activities as the person "forgets" proper alignment. If counter-balance measures are not taken, form will follow function as posture alignment migrates forward. When these habits are combined with the inevitable effect of gravity, which serves to "weigh down" the spine over time (because most body weight is located in front of the spine) the alignment is pulled forward and pushed down. Eventually outward appearance suffers and health problems may ensue.

Kyphosis-lordosis is an increase in the normal inward curve of the low back, accompanied by a protruding abdomen and buttocks, increased flexion (outward curve) of the thoracic spine, rounded shoulders and a forward-tilted head. Many faulty postural conditions (70–80%) are of this nature.

The conditions of kyphosis-lordosis are not inevitable since muscles work in opposites (agonist/antagonist). If one muscle is contracted the opposite muscle must relax to allow the movement to occur. For example, if the biceps contracts around the elbow to perform an arm curl, the tricep must relax. Likewise, if one muscle is tight, the opposite muscle will become loose. The biomechanic conditions responsible for a kyphosis-lordosis condition are:

- neck in a constant flexed (forward) position causes musculature adjoining in front (neck flexors) to tighten and pull the shoulders forward. They will maintain that position until stretched, allowing a return to normal alignment
- neck in a constant flexed (forward) position causes musculature adjoining in back (cervical extensors & trapezius) to lengthen, allowing the neck and head to lean forward. They will maintain that position until strengthened, forcing a return to normal alignment.
- shoulders in a constant flexed (forward) position causes musculature adjoining in front (deltoid and pectoral muscles) to tighten and pull the shoulders forward. They will maintain that position until stretched, allowing a return to normal alignment.
- shoulders in a constant flexed (forward) position causes musculature adjoining in back (mid-trapezius, rhomboids, deltoids,) to lengthen, allowing the shoulders to rotate forward in rested position. They will maintain that position until strengthened, forcing a return to normal alignment.
- trunk muscles in a constant flexed position cause muscular adjoining in front (abdominals/obliques) to tighten and pull the trunk forward. They will maintain that position until stretched, allowing a return to normal alignment
- trunk muscles in a constant flexed (forward) position cause muscular adjoining in back (spinal erectors) to lengthen, allowing the trunk to lean forward. They will maintain that position until strengthened, forcing a return to normal alignment
- a hip in a constant flexed (forward) position causes musculature adjoining in front (hip flexors) to tighten and pull the hips forward. They will maintain that position until stretched, allowing a return to normal alignment.
- a hip in a constant flexed (forward) position causes musculature adjoining in back (hip extensors) to lengthen, allowing the hips to tilt forward. They will maintain that position until strengthened, allowing a return to normal alignment.

Six corrective therapies are conventionally employed in combination for the conventional treatment of kyphosis-lordosis postural faults: heat; massage (with possible chiropractic manipulation); stretching; strengthening exercises; supportive measures (braces) to treat ligaments, bones, and nerves; and education.

An object of this invention is to provide a posture correction exercise device effective in treatment of kyphosis-lordosis postural faults by aiding the restoration of proper spinal alignment through three separate biomechanical exercises consisting of extension of the lumbar region of the body against resistance, contraction of the mid-trapezious, rhomboid, posterior deltoid muscles against resistance, and stretching of the neck flexor muscles, the trunk abdominal muscles, trunk abdominal oblique muscles and hip flexor muscles by exercise of the user's body occasioned by use of the posture correction exercise device.

It is an object of this invention to provide a posture correction exercise device specifically directed to correction of kyphosis-lordosis postural faults by exercising, strengthening and stretching the muscles of the body significant in correcting the conditions of kyphosis and lordosis.

It is an object of this invention to provide a posture correction device to exercise and strengthen the spinal erectors to pull the spine and human torso backward into normal alignment to aid in correction of a condition of lordosis.

It is an object of this invention to provide a posture correction device to exercise, lengthen, strengthen the mid-trapezious, rhomboid and posterior deltoid muscles to pull the shoulder blades of the user together against resistance to force the shoulders into normal alignment to aid in correction of a condition of kyphosis.

It is an object of this invention to provide a posture correction device to exercise, shorten and strengthen the spinal erectors to pull the spine and torso backward into normal spinal alignment, to lengthen and exercise the mid-trapezious, rhomboid and posterior deltoid muscles to pull the shoulder blades together of the user to force the shoulders into normal alignment and the head in a forward position to complete spinal realignment with suitable stretching exercises accomplished through separate stretching strategies to aid in correction of the condition of kyphosis-lordosis.

BRIEF SUMMARY OF THE INVENTION

A posture correction exercise device is disclosed to aid in correcting the common postural condition of kyphosis lordosis by aiding in the exercise of the spinal erectors to strengthen the erectors to pull the user's spine and torso backward into normal alignment and by exercise of the mid-trapezious, rhomboid and posterior deltoid muscles to strengthen these muscles to pull the user's shoulder blades together and force the shoulders into normal alignment. The device operates by seating the user upon an inclined seat to provide increased resistance by gravity to backward movement of user's body and backward rotation of user's arms against a tension assembly mounted on the resilient upright support and resistance against tension provided by a back rest tension assembly of said resilient upright support against backward movement by the user's body wherein hands of the user are positioned in supinated palms-up hand positions by grasping ball grips affixed under rotatable arm positioners of the device at the exterior ends of the arm positioners.

The posture correction exercise device includes a rectangular inclined support frame which supports a seat and tension assembly at an inclined angle, an alternative foot rest comprising a foot harness saddle or an alternative adjustable foot rest with an adjustable racket mechanism for support and placement of user's feet, a seat and back rest suitably mounted on said rectangular support frame to position user upon said exercise device, a resilient upright support with means of providing tension and with a suitable and adjustable range of motion to support said back rest and two positioning handle arms, and to provide adjustable tension for user against backward movement of user's body against said back rest to provide lumbar muscle extension, two arm positioners as positioning handle arms for support and positioning of the user's arms for rearward rotation to provide mid-trapezious/rhomboid/posterior deltoid muscle contraction, the two rearward rotational arm positioners positional against resistance to a suitable angle from the rectangular side of the support frame within a range of up to 80°, two ball grips positioned on exterior ends of said two arm positioners mounted under bent section of said two arm positioners to guide and provide a grip for user's hands in supinated palms-up hand position, a tension assembly mounted at exterior end of said resilient upright support in joining arrangement with said two arm positioners to provide tension to said two arm positioners to create resistance to rearward motion of said two arm positioners, an adjustable back rest positioning means comprising two lift pins and a positioning bracket for said two lift pins to provide adjustment of height of said resilient upright support and said back rest, and an adjustable pelvic restraint belt to provide stabilization of user's pelvis and to provide restraint to raising of user's hips during movement.

DETAILED DESCRIPTION

Field of the Invention

Figure 1:
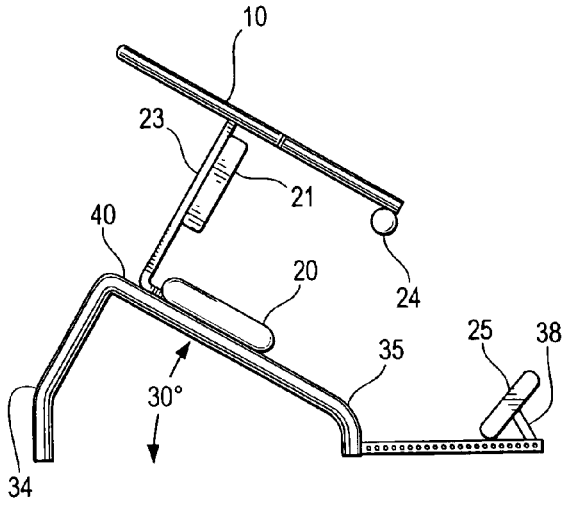
FIG. 1 is a side view of a first embodiment of the invention.
Figure 2:
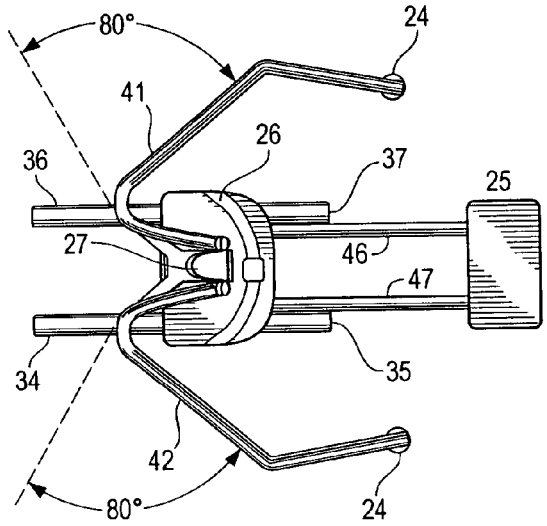
FIG. 2 is a top view of a first embodiment of the invention.
Figure 3:
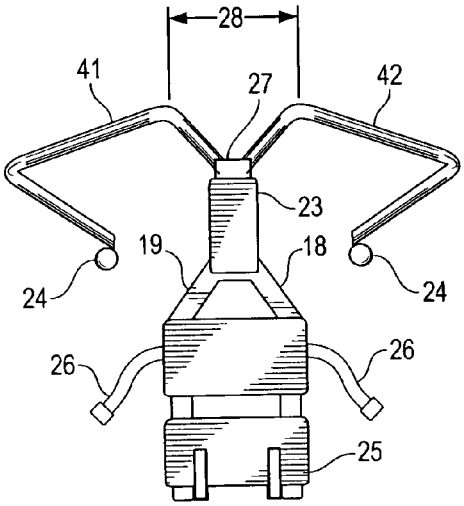
FIG. 3 is a front view of a first embodiment of the invention.

This invention relates to a posture correction exercise device. The device is designed to operate to correct postural faults related to abnormal backward curvature of the spine (kyphosis) coupled with abnormal forward curvature of the spine (lordosis). The posture correction exercise device aids in restoring proper spinal alignment by aiding in the exercise of the spinal erectors to strengthen the erectors to pull the spine and torso backward into normal alignment and by the exercise of the mid-trapezious, rhomboids and posterior deltoid muscles to strengthen these muscles to pull the shoulder blades together, thereby forcing the shoulders into normal alignment.

Description of the Prior Art

The prior art describes many types of exercise apparatus designed to exercise specific muscles, muscle groups or areas of the body.

For example, U.S. Pat. No. 6,312,366 to Prusick discloses an exercise device to exercise the abdominal and lower back muscles wherein the user sits on a generally horizontal seating surface and utilizes a resilient upright member from the rear of the seating surface to provide exercising resistance for the lower back when pressure is exerted against it by the user's upper back, and resistance to the abdominal muscles when pressure is exerted forward by the user by bending forward. U.S. Pat. No. 6,213,923 to Cameron, et al., discloses an adjustable chair which may be declined at varying angles by a user wherein the angle of decline and amount of resistance to movement of the chair is controlled by the user. The user pushes backward against the chair resistance to effect back exercises to strengthen the muscles of the lower back and abdomen. The U.S. Pat. No. 6,059,701 to George, et al., teaches an apparatus for exercising the muscles of the lower back wherein the user kneels upon a pad and leans forward with his upper back engaged with the back pad of a lever for a resistance arrangement of weight elements. As the user bends backward the user's back presses against the lever, causing the weight elements to be lifted, thus providing resistance to the spinal erector muscles.

U.S. Pat. No. 5,599,261 to Easley, et al., and U.S. Pat. No. 5,256,126 to Grotstein disclose exercise devices directed to exercising abdominal and lower back muscles. Easley '261 discloses a device wherein the user sits upon a seat, grips hand grips and bends forward against resistance to exercise the abdominal muscles and bends backward against resistance to exercise the lower back muscles. Grotstein '126 discloses a frame upon which the user sits and leans forward or backward against resistance to exercise the abdominal or lower back muscles. Exercise devices for exercising lower back muscles are disclosed by Foster, U.S. Pat. No. 5,288,130, and Jones, U.S. Pat. No. 4,500,089. Foster '130 discloses an exercise chair designed to provide stabilization of the pelvis during exercise for the lower back to isolate the lumbar region from powerful leg muscles in order to exercise muscles of the trunk. Jones '089 discloses a device with a saddle-type seat for the user in up-right position. A padded roller connected with weights provides variable resistance for lifting and lowering the weights. Chiu, et al., U.S. Pat. No. 5,833,590, and Fong, U.S. Pat. No. 5,100,131 disclose stretching exercise devices for back muscles exercising and stretching. Chiu '590 discloses a base frame on which the user sits and leans backward and forward against resistance. Fong '131 discloses a stationary seat on which the user sits and a backrest. The user presses against resistance of the backrest by pressing backward or forward. The stretching of both Chiu '590 and Fong '131 is accomplished by leaning backward upon a back rest. Anderson, U.S. Pat. No. 5,496,247, discloses an exercise bench for strengthening the muscles of the lower back by having a seat mounted to an inclined beam and a knee brace mounted to the beam. The user bends forward and, backward against the angle of the incline.

Referring to FIGS. 1–6, there is shown a preferred first embodiment of exercise device 10 suitable for accommodating a user in a seated position. Exercise device 10 has a rectangular inclined frame 40 supporting the padded vinyl seat 20 and resilient upright support 23 supporting rotatable arm positioners 41 and 42. Tension assembly 28 comprising adjustable tension band 27 engages arm positioners 41 and 42 and compresses to provide tension to arm positioners 41 and 42 to provide resistance for rear-ward rotation of arm positioners 41 and 42. Exercise device 10 inclined support frame 40 has inclined vertical support posts 34, 35 and 36, 37, 34 and 36 the supporting posts of the rear end of support frame 40, and 35, 37 the supporting posts of the forward end of support frame 40.

The inclined support frame 40 is inclined at an angle of approximately 30° relative to the horizontal and at an elevated position above the horizontal. The angle of inclination is chosen to increase the muscular activity required for moving the user's body from a forward leaning position to a backward leaning position and thus to exercise the spinal erectors to strengthen the erectors and mid-trapezious, rhomboid and posterior deltoids to pull the spine and torso backward. An angle ranging from about 20° to about 40° is considered to be useful for this purpose and provide effective muscular exercise. The angle of 30° plus and minus about 10° has been chosen as providing sufficient muscular exercise to the user that the user will stay with the program to correct postural faults and reach their objective without experiencing the loss of initiative as compared to many exercise programs. However, an angle greater than 30°, of about 45°, can decrease the user's sense of balance. An angle of less than 30° will require the support frame to be extended in length. The angle of 30° is considered to be preferable.

A seat member 20 is affixed to the top rear surface of the inclined support frame 40. Padded vinyl backrest 21 is affixed to resilient upright support 23. Resilient and tension assembly upright support 23 supports arm positioners 41 and 42 affixed to upright support 23 in conjoint attachment with tension assembly 28. Arm positioners 41 and 42 are shaped in accordance with the user's arms to accommodate the user to grasp ball grips 24 in a palms-up position, in a supinated hand position. Pelvic restraint belts 26 are affixed to the inclined support frame 40 under the seat member 20 of sufficient length to accommodate the user. An optional adjustable foot rest 25 with adjustable racket-type support mechanism 38 provides support and placement for the user's feet. Alternative foot harness saddle 55 (not shown) or foot rest 25 and alternative support mechanism 38 are affixed to racket foot rest extension arms 46 and 47. The foot rest 25 and support mechanism 38 or foot harness saddle 55 are optional components of the posture correction exercise device as the user can use the floor for the exercise device for support and placement of the user's feet. The tension assembly 28 for tension against backward rotation of the user's arms can comprise an adjustable tension band 27 assembly of resilient band members which engage the two arm positioners to provide resistance to backward rotation of the two arm positioners 41 and 42. The resilient members 27 are selected from conical, coiled spiral, coiled, leaf or clip springs of metal or plastic material of sufficient resiliency to provide sufficient resistance to movement of the arm positioners in rearward motion. Replaceable resilient members 27 of varying resiliency provide means of adjusting the tension of the tension band assembly 28. The tension band assembly 28 can comprise one or more resilient members for adjustment of resistance. An alternative tension assembly for tension against backward rotation of the user's arms can comprise two torsion bars 51 and 56 mounted vertically and parallel to the upright support bar 23 as showing in FIG. 10.

With regard to means for fastening, mounting, attaching or connecting the components of the present invention to form the exercise device 10 as a whole, unless specifically described as otherwise, such means are intended to encompass conventional fasteners, such as machine screws, rivets, nuts and bolts, toggles, pins and the like. Unless specifically otherwise disclosed or taught, materials for making the components of the present invention are selected from appropriate materials such as aluminum, steel, metallic alloys, various plastics, and vinyls or the like. The inclined support frame can be of tubular construction materials for lightness of weight, and alternatively of solid construction of other than of tubular materials. The resilient upright support can be a spring steel upright support and, alternatively, can be of a suitable resilient plastic material which provides resilient upright support.

Referring to FIGS. 1–6, in order to properly use the present invention to exercise in the first embodiment, the angular formed body support of inclined support frame 40 provides support which supports the exerciser in a leaning forward position with his upper body supported by his downwardly positioned legs and feet in foot harness saddle 55 or against the adjustable foot rest 25 or against the support floor surface. The pelvic restraint belt 26 is fastened around the user's hips. The user's arms are raised in front of the user, perpendicular to the user's torso with the hands in palms-up position gripping the ball grips 24 on the underside ends of handle arms 41 and 42. The resilient upright support 23 is alternatively adjusted for positioning of back rest 21 using dual lift pins 50 and 51 inserted in the back of seat 20 and a series of support holes in the two alternative support end arms 18 and 19 of the resilient upright support 23. The two support end arms 18 and 19 of the resilient upright support 23 are secured further by adjustment support holes in support arm 17 affixed to inclined support frame 40 of exercise device 10. The mid-back of the user is flush against the padded back rest 21. The user's torso leans forward.

The resilient upright support 23 mounted on the inclined support frame has a suitable and adjustable range of motion of up to 40° plus and minus 10° backward from the perpendicular to the inclined support frame 40. The adjustable band assembly 27 comprises an adjustable tension band assembly 28 mounted at the top end of said resilient upright support 23 and engaging two arm positioners 41 and 42 to permit pressing resistance movements of the user's arms. The two arm positioners 41 and 42 are positional against resistance provided by the resilient members of the adjustable band assembly 28 up to a suitable angle within the range of up to 80° plus and minus 10° from the rectangular side of the support frame, each arm positioner having a ball grip under each arm positioner for the user's hands to grip in supinated palms up position. The resilient upright support is mounted perpendicular to the angle of the angle of the inclined support frame. The angle of said inclined support farme of said seat and said tension band assembly is in the range of 30° plus and minus 10°. Stabilization is provided to the user's body by a foot rest or foot saddle for the user's feet or by the support floor. Pelvis stabilization is provided for the user's body by a pelvic restraint belt. The user's hips are prevented from being raised during movement by the pelvic restraint belt attached to the support frame in juxtaposition to the backward end of the user's seat. The resilient upright support 23 can be a spring steel upright support and, alternatively, can be a resilient plastic upright support of any suitable resilient plastic material. The plastic material can be selected from the group consisting of nylon, polycarbonate, neoprene rubber, butyl rubber, silicone rubber and any synthetic elastomer suitable for the resilient requirements. The plastic material can be glass-reinforced to aid strength and resilience.

Figure 4:
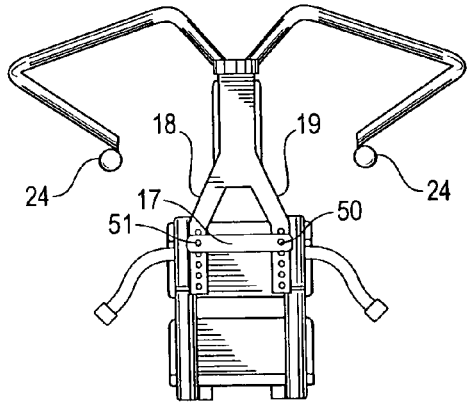
FIG. 4 is a back view of a first embodiment of the invention.
Figure 5:
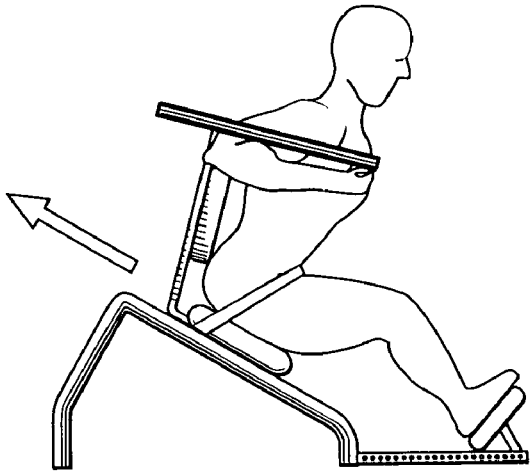
FIG. 5 is a side elevation view of a first embodiment of the invention showing the user's exercise position.
Figure 6:
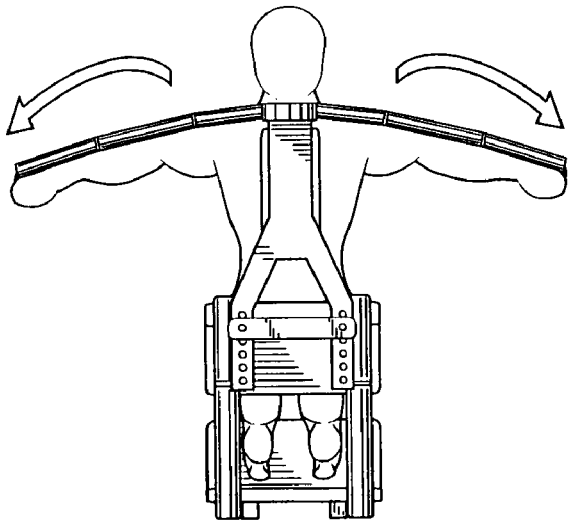
FIG. 6 is a back elevation of a first embodiment showing the user's exercise position.

Referring to FIG. 4, dual lift pins 50 and 51 are inserted in the back of seat 20 for alternative adjustment of seat back 23 of a first embodiment of the invention.

To begin movement, the user will simultaneously lean backward (lumbar extension) through a backward range of motion of up to 40° plus and minus 10° by pressing backward with force through the user's legs and feet, forcing the user's mid-back into back rest position through a 40° angle plus and minus 10° while rotating arms and shoulders rearward with both hands grasping the ball grips 24 (mid-trapezious, rhomboids, posterior deltoid muscles contraction). The movement will finish with the backward lean of the user's torso to roughly 40° (complete contraction of spinal erectors) and rearward rotation of the user's arms from forward position to parallel with the top of the backrest forming a "T" shape (complete contraction of mid-trapezious, rhomboid, posterior deltoid muscles).

The tension of the resilient upright support 23 to adjust the lumbar extension force and the tension of the tension bands 27 to adjust the mid-trapezious, rhomboid, deltoid muscles contraction force can be adjusted by exchanging with other resilient upright supports and tension bands of differing tensions.

In an alternative method of using the posture correction exercise device of the first embodiment, the 30° angle of the seat position from the horizontal allows the user with his arms in position to sit on the exercise device from a semi-standing position with knees bent and feet flat on the floor. From a semi-standing position, the user's body weight through the feet and gluteus muscles will stabilize the user's torso during the motion. Since the user can be bending backward to as much as 60° from the horizontal, stabilization of the user's body by a foot rest or seatbelt is not necessary although a greater degree of bending backward could require such stabilization by a footrest or foot harness saddle, or seat belt.

Additionally, the inclined 30° plane of the support frame 40 is conducive to seating requirements with the user's arms and hands in position particular to the height of the user. A steeper angle such as 45° would decrease the effect of body weight for stabilization. A smaller angle would tend to increase the length and size of the device. The 30° angle is conducive to a slight forward anterior tilt of the pelvis of the user as the arms are rotated backward at the end of an exercise motion. The pelvic tilt aids in achieving isolation of the spinal erectors without use of other devices. The slight pelvic thrust forward by the user leaning backward creates a concavity of the user's back by extension of the spine with tension provided between the shoulder blades by tension band 27 and the supinated position of the hands upon the ball grips 24.

The 30° angle of the inclined support frame 40 sets the angle of upright support 23 and padded back rest 21 at a 60° angle to the horizontal to allow at least a 30° range of motion for the back extension of the user's backward motion. Additionally, upright support 23 and padded back rest 21 can restrain a forward movement by the user with the user's arms and hands in position from the 60° angle to the horizontal under tension by the tension band 27.

The utility of the handle arms 41 and 42 shaped to accommodate the user's arms to cause the user to grasp the ball grip in a palms-up supinated position is that with the user's arms extended in front and hands in the supinated position, the user's forearms are extended and elbows are pointed downward. As the arms are rotated backward in a range of motion of up to 40° plus and minus 10°, the elbows remain pointed downward. In this position, the shoulders are rotated backwards in an external rotation. As the motion by the user continues, the shoulders rotate downwards because of the movement of the scapula shoulder blades which are simultaneously moving together in an adduction movement and downward in a retraction movement. In the finished movement, the user's palms are up, the user's shoulders are downward and backward and the user's chest is elevated in a correction of the kyphosis-lordosis condition to train the user's muscles in the position for good posture.

Failure of palms to be supinated position, that is, to be in pronated or neutral positions diminishes the likelihood of achieving the correction of the kyphosis lordosis condition and of training the body muscles in the position of good posture. Unless the user's palms are not supinated in a palms up position, the upper trapezious muscles tend to "take over" when the arms are rotated backward, forcing the shoulders to go upward and forward instead of downward, thus losing the training effect of the exercise.

Additionally, a consequence of the shoulders moving upward and forward, because the user's palms are not in a supinated position, is that as the shoulders move forward, the user's arms will rotate medially toward the middle of the body along the vertical axes in a standing position and the user's hands will follow to a pronated palms facing backward position.

An alternative second embodiment of the invented posture correction exercise device to aid in correcting the common postural condition of kyphosis lordosis comprises a device which operates by seating the user upon an inclined seat to provide increased resistance by gravity to backward movement of user's body and backward rotation of user's arms against a tension bar assembly mounted on the resilient upright support and resistance of said resilient upright support, said resistance of said resilient upright support occasioned by a second tension bar assembly at the base of said upright support wherein hands of the user are positioned in supinated palms-up hand positions by grasping ball grips affixed under rotatable arm positioners of the device at the exterior ends of the arm positioners. The alternataive embodiment includes a rectangular inclined support frame assembly which embodies two foot saddles to house user's feet, the foot saddles affixed to floor forward support guides of frame assembly, the support rear guides of the frame assembly equipped with locking push pins to lock support rear guides of the frame assembly into upright position from a folding storage position, the frame assembly supporting a slidable seat on the dual support guides, a compression dial bracket engaging the dual support guides for seat position adjustment, the frame assembly supporting the resilient upright support and the tension bar assembly mounted thereon.

An alternative third embodiment of the torsion bar assembly comprises a flex band affixed to said rotatable arm positioners, the flex band providing tension to user's arms. As the arms are rotated backwards, the flex band compression increases tension. The alternataive third embodiment comprises means for folding the rear legs of the device frame and the upright support bar with attached components to allow storage of the device.

Referring to FIGS. 7–14, the figures illustrate alternative second and third embodiments of the invented device. Designations of elements specific to FIGS. 1–6 are designated and labeled the same in FIGS. 7–14. Additional elements in FIGS. 7–14 are designated and separately described.

Figure 7:
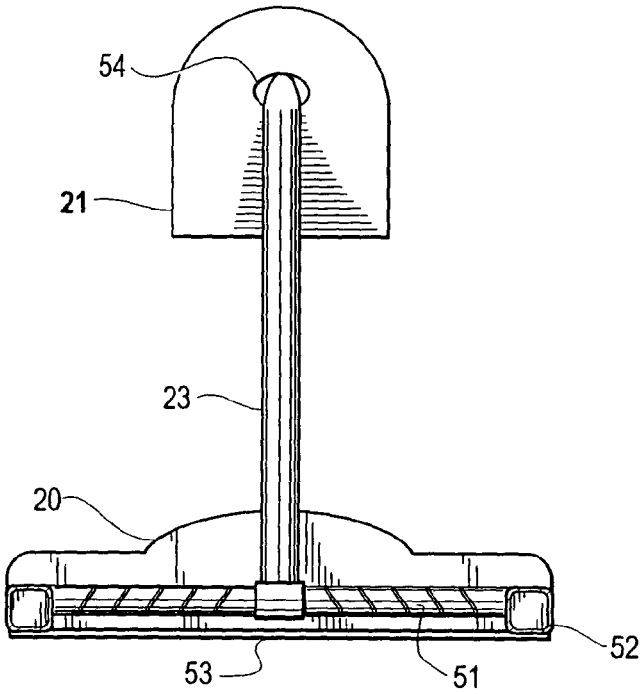
FIG. 7 is a back view of a generalized embodiment of an alternative second embodiment of the invention shown as a schematic diagram of the adjustable resilient upright support affixed to a base tension bar assembly of the resilient upright support.
Figure 8:
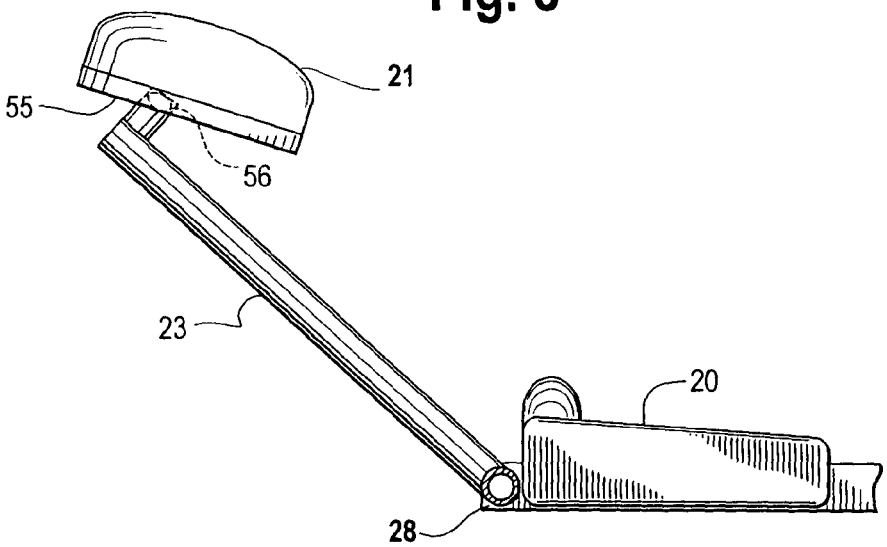
FIG. 8 is a side view of the alternative second embodiment of the schematic diagram of FIG. 7 showing the upright and backward leaning positions against resistance tension of base tension bar assembly.

FIG. 7, a back view and FIG. 8, a side view, illustrate an alternative second embodiment of an adjustable support bar and related components. In FIG. 7, resilient upright support 23 engages hexangonal shaped tension bar 51 with face plate hubs 52 of seat face plate 53 to provide backward tension as tension assembly 28. Back rest 21 is mounted on upright support 23 by means of ball swivel joint 54 comprising a ball 55 inserted into ball socket 56 of back rest 21. Seat face plate 53 supports seat 20. FIG. 8 illustrates the side view of FIG. 7 in a backward movement of support bar 23 under tension of the tension assembly 28 comprising tension bar 51 and face plate hubs 52 of seat face plate 53.

Figure 9:
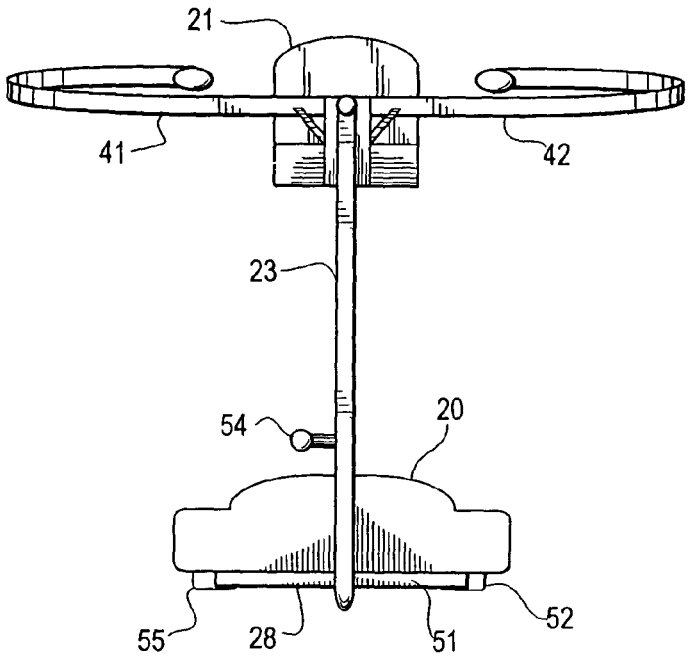
FIG. 9 is a back view of a generalized embodiment of an alternative second embodiment of the invention shown as a schematic diagram of the components of the arm torision bar assembly and the base torision bar assembly.

FIG. 9 illustrates an alternative second embodiment of the support arm components of FIGS. 7 and 8 with arm supports 41 and 42, back rest 21, resilient upright support 23, seat 20, tension assembly 28 comprising tension band 51 and 53 face plate hubs 52 of seat face plate 53, and attachment of resilient upright support 23 to seat 20 with set pin 54 for insert holes 55 (not shown in seat face plate 53).

Figure 10:
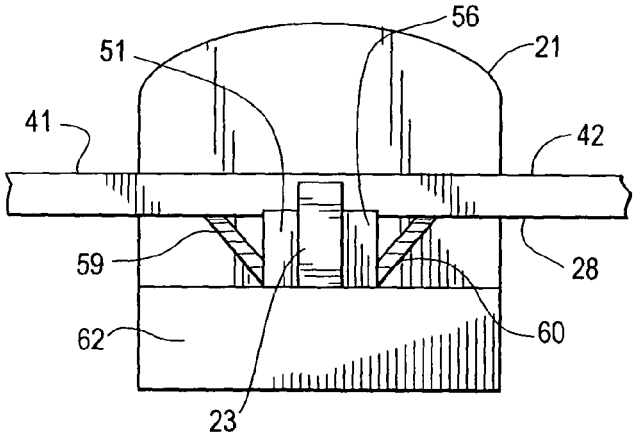
FIG. 10 is a back view of a generalized embodiment of an alternative embodiment of the back pad tension bar of FIG. 9 showing as a schematic diagram.

FIG. 10 illustrates an alternative second embodiment as a back view of the tension assembly 28 of FIG. 9. The back view shows torsion bars 51 and 56 mounted parallel vertically with upright support 23, said torsion bars 51 and 56 affixed to arm supports 41 and 42 by support members 59 and 60 backrest 21. Ball joint attachment of back rest to upright support is not shown. Back rest cover plate 62 covers lower holding engagement of torsion bars 51 and 56 with back rest 21.

Figure 11:
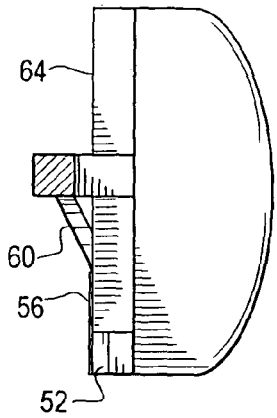
FIG. 11 is a side view of the alternative embodiment of the back pad tension bar assembly of FIG. 9 shown as a cutaway of the back pad of FIG. 10.

FIG. 11 illustrates the details of alternataive second embodiment back view of FIG. 10 as a side view showing back plate 64 which supports the tension assembly 28 inside back pad 23.

Figure 12:
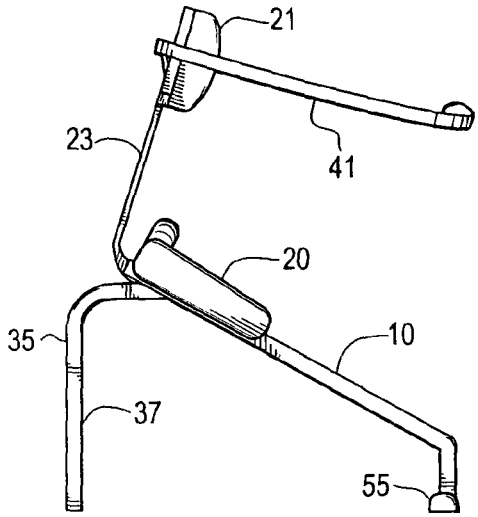
FIG. 12 is a side view of a generalized third embodiment of an alternative embodiment of the instant invention frame assembly as a schematic diagram.

FIG. 12 illustrates an alternative generalized third embodiment of the frame assembly 10 of FIG. 1 as a side view showing the angle of incline of frame 10 supporting seat 20, upright support 23 and back rest 21. An alternative foot harness saddle 55 is shown as engaged by floor forward engagement ends of frame 10 support members 37 and 35.

Figure 13:
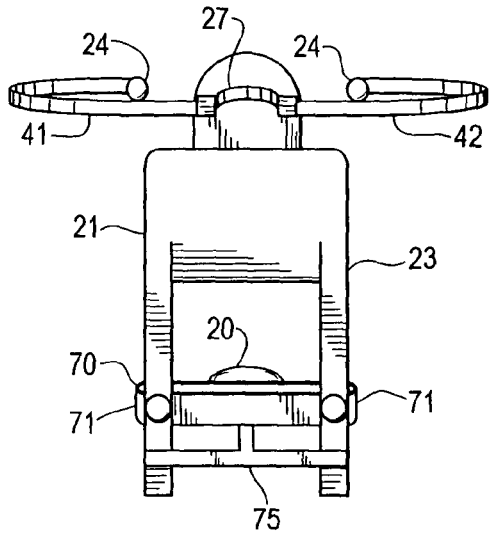
FIG. 13 is a back view of a generalized fourth embodiment of an alternative embodiment of the invention shown as a schematic diagram with a flex band.

FIG. 13 illustrates an alternative fourth embodiment of the invented posture device as a back view of the upper component assembly. FIG. 13 illustrates tension assembly 28 comprising adjustable tension band 27 which engages arm positioners with ball grips 24, up right support 23 as a leaf spring. Padded seat 20 supports user. Back pad 21 is affixed to upright support 23. Hinged bracket 70 on rear support legs of frame 10 folds back legs 36 and 37 of frame 10 to fold forward inward to compact the instant device for storage. Spring loaded plunger 71 affixes leaf spring upright support 23 to hinged bracket 72 (not shown) to fold forward the upper component assembly of arms 41 and 42, upright support 23, tension assembly 28, back rest 21 the compact for storage, cross bar 75 prevents upper component assembly from folding forward as device is in use.

Figure 14:
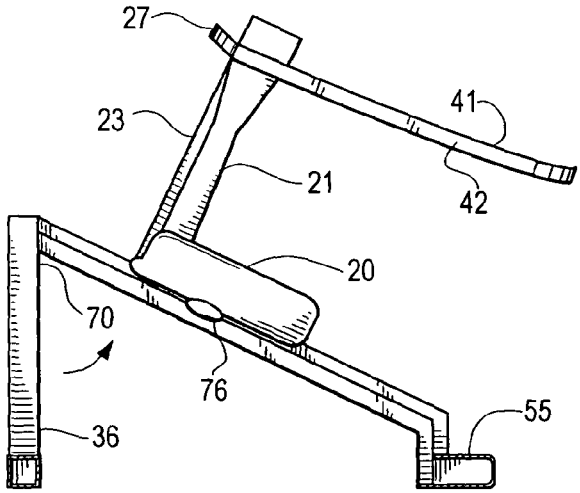
FIG. 14 is a side view of the frame assembly with a flex band of FIG. 13 and illustrates the hinged bracket legs for the lay-flat structure of the frame assembly.

FIG. 14 is a side view of the alternative fourth embodiment of FIG. 13 which illustrates hinged bracket 70 of rear support legs of frame 10, the alternative foot harness saddles 55 of FIG. 12, the tension assembly 28 comprising tension band 27, upright support 23, and a compression screw assembly 76 which hold seat 20 in position of frame 10 when tightened in place. The hinged bracket 70 permits the device to be folded for storage.

The posture correction exercise device aids in restoring proper spinal alignment through three separate biomechanical actions:

1. Lumbar extension:
   The backward (40°) lean of the torso into the resistance of the back rest and adjoining spring steel back exercises the spinal erectors. These muscles under the condition of kyphosis lordosis are weak and lengthened. When strengthened, the erectors will pull the spine and torso backward into normal alignment.
2. Mid-trapezious/rhomboids/posterior deltoids contraction:
   The rotation of the arms and shoulders from a forward position (palms-up); backward into parallel with the back rest guided by steel handles and ball grips into resistance afforded by steel tension band serve to exercise the mid-trapezious, rhomboid and posterior deltoids. These muscles under the condition of kyphosis lordosis are weak and lengthened. When strengthened, they will pull the shoulder blades together forcing the shoulders into normal alignment.
3. Stretching:
   Proper stretching of the neck (flexors), trunk (abdominals, obliques) and hip (flexors) aid in realignment of the spine and shoulders.
4. When the torso and shoulders are pulled back, the head (in a forward position) will follow suit completing total spinal realignment.

Use of the posture correction exercise device offers an affordable easy-to-use alternative to aid in the postural rehabilitation of the most common form of misalignment (kyphosis lordosis). It is believed that use of the device for just minutes a day at a frequency of 3 times a week should prove sufficient in correcting most problems. Given the high frequency of failure of most exercise programs; the posture correction device (although not a significant muscle building or fat-burning device) offers a high return on overall health considering the limited amount of time invested. Therefore, users are more likely to stay with the program and reach their goals when compared to any other fitness pursuit.

What is claimed is:

1. A posture correction exercise device comprising, in combination,
   a. an inclined support frame for support of a seat, a tension assembly wherein an angle from the horizontal of said support frame of said seat and said tension band assembly is in the range from 20° to 40° from the horizontal and an adjustable foot rest supports the feet of a user seated on said seat,
   b. a backward resilient upright support mounted on said support frame which resilient upright support has a resilient and adjustable range of movement from 40° plus and minus 10° backwards from the perpendicular position to the inclined support frame,
   c. said tension assembly comprising an assembly of replaceable resilient members mounted at the top end of said resilient upright support and engaging two backward rotation arm positioners with resistance of user's arms to backward rotation,
   d. said two backward rotation arm positioners for backward rotation against resistance at top of said resilient upright support to a angle within the range of up to 80° plus and minus 10° from the rectangular side of said inclined support frame, each arm positioner having a ball grip under each arm positioner for the user's hands to grip in supinated palms up position.

2. The posture correction exercise device of claim 1 wherein said resilient upright support is mounted perpendicular to said frame.

3. The posture correction exercise device of claim 1 wherein angle of said support frame of said seat and said tension band assembly is in the range of 30° plus and minus 10°.

4. The posture correction exercise device of claim 1 wherein stabilizer is provided for the user's body comprising a foot rest.

5. The posture correction exercise devise of claim 1 wherein stabilitzation is provided for the user's body by a foot rest comprising a foot harness saddle.

6. The posture correction exercise device of claim 1 wherein a pelvis stabilizer is provided for the user's body comprising a pelvic restraint belt and user's hips are prevented from being raised during movement by said pelvic restraint belt attached to said tubular support frame in juxtaposition to the backward end of said seat.

7. The posture correction exercise device of claim 1 wherein said inclined support frame includes an inclined support frame of tubular construction materials.

8. The posture correction exercise device of claim 1 wherein said inclined support frame is made from solid construction materials.

9. The posture correction exercise device of claim 1 wherein said resilient upright support is a spring steel support.

10. The posture correction exercise device of claim 1 wherein said resilient upright support is made from resilient plastic upright support of a resilient plastic material.

11. The posture correction exercise device of claim 1 wherein material of said resilient upright support is selected from the group consisting of nylon, polycarbonate, neoprene rubber, butyl rubber, silicone rubber, and any synthetic elastomer suitable for the resilient requirements of providing a suitable resilient range of motion of up to 40° plus and minus 10° backward from the perpendicular to the support frame to a resilient upright support mounted on said support frame.

12. The posture correction exercise device of claim 1 wherein said resilient upright support is a resilient plastic upright support of a suitable glass-reinforced resilient plastic material.

13. The posture correction exercise device of claim 1 wherein said tension band assembly comprises an adjustable tension band assembly of said replaceable resilient members which engage said two arm positioners to provide resistance to backward rotation of said two arm positioners.

14. The posture correction exercise device of claim 1 wherein said tension band assembly comprises replaceable resilient members selected from conical, coiled spiral, leaf or clip springs of metal and plastic material sufficient resiliency to provide sufficient resistance to movement of said arm positioners in rearward motion.

15. The adjustable tension band assembly of claim 14 wherein said plastic material is glass-reinforced.

16. A posture correction exercise device wherein said device comprises, in combination, an inclined rectangular support frame which supports a seat and tension assembly at an inclined angle, an alternative foot rest for support and placement of user's feet, a seat and adjustable back rest suitably mounted on said rectangular inclined support frame to position user upon said exercise device, said adjustable back rest mounted with two lift pins and a positioning bracket, a resilient upright support to support said back rest and two arm positioners, said resilient upright support to provide tension for user against backward movement of user's body against said back rest to provide lumbar muscle extension, two backward rotation arm positioners for support and positioning of user's arms for rearward rotation through a range of up to 80° to provide mid-trapezious/rhomboid/posterior deltoid muscle contraction, two ball grips positioned on exterior ends of said two arm positioners, mounted under exterior section of said two arm positioners to guide and provide a grip for user's hands in supinated palms-up hand position, a tension assembly mounted at exterior end of said resilient upright support in joining arrangement with said two arm positioners to provide tension to said two arm positioners to create resistance to rearward motion of said two arm positioners.

17. The posture correction exercise device of claim 16 wherein said tension assembly comprises a tension band assembly.

18. The posture correction exercise device of claim 16 wherein said tension assembly comprises a torsion bar.

19. The posture correction exercise device of claim 16 wherein said resilient upright support provides resiliency by means of a resilient member.

20. The posture correction exercise device of claim 19 wherein said resilient member comprises a spring steel support.

21. The posture correction exercise device of claim 19 wherein said resilient member comprises a torsion bar assembly.

22. The posture correction device of claim 16 wherein said alternative foot rest comprises a foot harness saddle.

23. The posture correction device of claim 16 wherein said alternative foot rest comprises an adjustable foot rest with adjustable racket mechanism.

24. The posture correction device of claim 16 wherein said two lift pins and positioning bracket for said two lift pins provide adjustment of height of said upright support.

25. The posture correction device of claim 16 wherein an adjustable pelvic restraint belt provides stabilization of user's pelvis and provides restraint to raising of user's hips during movement.

26. The posture correction exercise device of claim 16 wherein legs and tension assembly of said device fold for storage.

* * * * *